US005887854A

United States Patent [19]

Musson et al.

[11] Patent Number: 5,887,854

[45] Date of Patent: Mar. 30, 1999

[54] IN-PLACE VEHICLE SERVICING SYSTEM

[76] Inventors: Donald M. Musson, 2615 Mercedes Dr., Atlanta, Ga. 30345; Anil Saigal, 2 Lee Ave., Burlington, Mass. 01803; Jan Griffioen, 18365 W. 13 Mile Rd. Apt. 34, Southfield, Mich. 48076

[21] Appl. No.: 835,726

[22] Filed: Apr. 11, 1997

[51] Int. Cl.[6] ..... B66F 7/26

[52] U.S. Cl. ..... 254/89 H

[58] Field of Search ..... 187/219, 220, 187/218, 221, 204, 242; 254/89 R, 89 H, 90

[56] References Cited

U.S. PATENT DOCUMENTS

| | | | |
|---|---|---|---|
| 3,331,470 | 7/1967 | Hott | 187/220 |
| 3,362,502 | 1/1968 | Clarke | 187/220 |
| 4,585,092 | 4/1986 | Dossier | 187/220 |
| 4,798,266 | 1/1989 | Finkbeiner | 254/89 H |
| 4,903,946 | 2/1990 | Stark | 187/220 |

*Primary Examiner*—Robert C. Watson
*Attorney, Agent, or Firm*—James B. Middleton

[57] ABSTRACT

An in-place automotive vehicle servicing system for servicing vehicles while in a parking lot or the like utilizes a servicing vehicle carrying a vehicle lifting apparatus. The vehicle lifting apparatus has a telescoping central beam with two pivotal cross-beams. The lifting apparatus is collapsed for carrying in the servicing vehicle, and is extended beneath a vehicle. Jacks carried at the ends of the cross-beams are positioned at the lift points of the vehicle to be serviced, and the jacks are operated to lift the vehicle. A control device is mounted with the lifting apparatus, and includes a computer to provide servicing information about the vehicle to be serviced, and preferably for assisting in aligning the jacks with the vehicle lifting points.

6 Claims, 3 Drawing Sheets

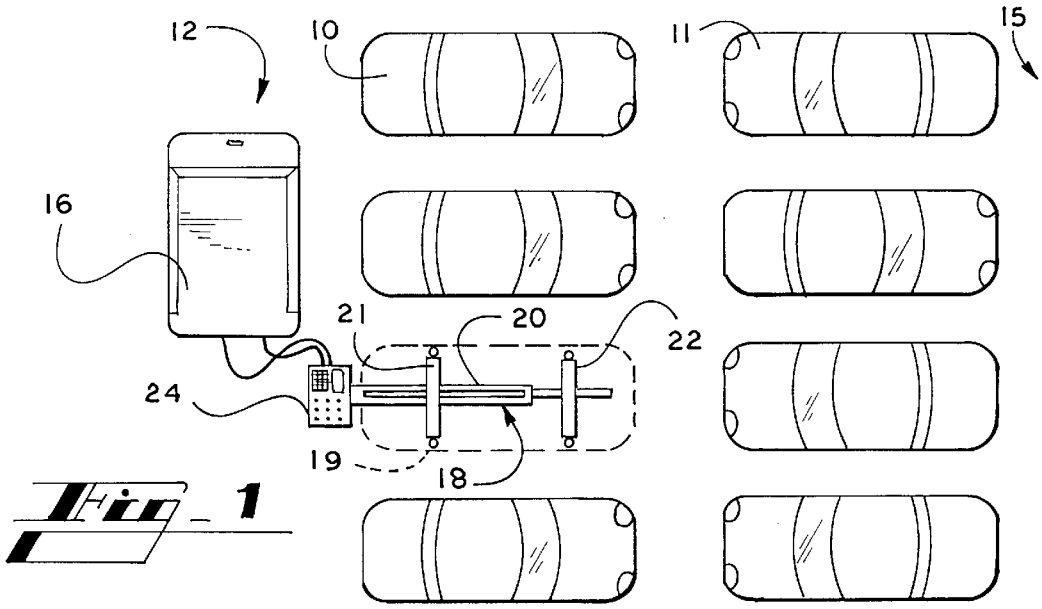
Fig. 1
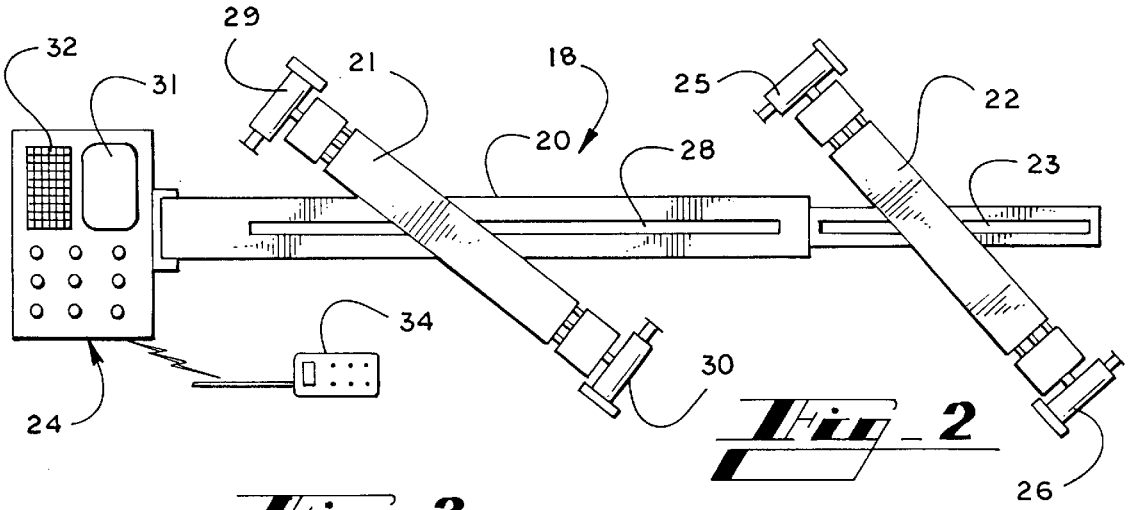
Fig. 2
Fig. 3
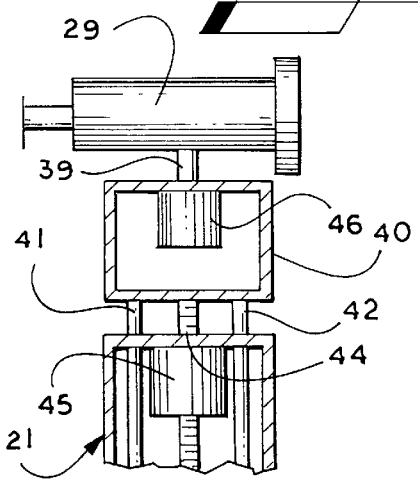
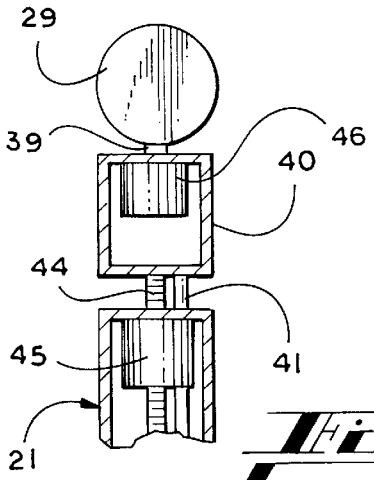
Fig. 4

IN-PLACE VEHICLE SERVICING SYSTEM

BACKGROUND OF THE INVENTION

1. Field of the Invention

This invention relates generally to the servicing of parked automotive vehicles, and is more particularly concerned with a portable lift apparatus and method for in-place service using the apparatus.

2. Discussion of the Prior Art

The Environmental Protection Agency has included the following in their brochure on reformulated gasoline: "A Major Step Toward Cleaner Air. Despite improvements in motor vehicle technology over the past 25 years, cars and trucks are still a major source of air pollution in the United States. This is largely because the number of vehicles on the road keeps growing, and the number of miles driven has doubled since 1970. This is one reason why more than 90 areas across the country have ozone levels higher than the national public health standards allow."

In 1970 Americans traveled one trillion miles in motor vehicles. They are expected to drive four trillion miles yearly by the year 2000. More people are driving more cars more miles on more trips.

The number of motor vehicles grew in the 15 years from 129,663,000 in 1980 to 181,031,000 in 1994. The latest statistics on driving to work in the United States are for 1990. In that year 84,215,000 people drove alone; 15,378,000 people carpooled. Only 5.3 per cent of workers 16 years of age and up used public transportation. The popularity, necessity and the usage of the motor vehicle is also illustrated by these brief facts:

| Year | Households with 3 or More Vehicles |
|---|---|
| 1969 | 2,875,000 |
| 1990 | 18,248,000 |

The 1990 total represents a 535 per cent change, 1969–1990

ROADWAY CONGESTION 1991

| Urbanized Areas | Freeway Daily Vehicle Miles of Travel Total Miles (1000) | Daily Vehicle Hours of Delay Total Hours | Congestion Cost Per Capita |
|---|---|---|---|
| 1. Baltimore | 25,820 | 130,470 | $270 |
| 2. Boston | 34,900 | 356,220 | 510 |
| 3. New York City | 133,650 | 1,544,140 | 390 |
| 4. Washington, D. C. | 41,470 | 575,280 | 740 |
| 5. Chicago | 62,780 | 555,790 | 310 |
| 6. Detroit | 38,160 | 383,690 | 400 |
| 7. Atlanta | 40,200 | 239,490 | 530 |
| 8. Dallas | 38,480 | 274,030 | 570 |
| 9. Houston | 47,500 | 409,970 | 600 |
| 10. Los Angeles | 177,550 | 1,835,240 | 660 |
| 11. San Francisco | 67,620 | 658,550 | 760 |
| Average 50 Urbanized Areas | 25,740 | 207,170 | 340 |

The 50 urbanized areas cited above were selected from the following geographical sections of the United States in the numbers shown:

| Geographical Section | |
|---|---|
| 1. Northeastern | 7 |
| 2. Midwestern | 12 |
| 3. Southern | 11 |
| 4. Southwestern | 11 |
| 5. Western | 9 |

Many people live some distance away from their work places, transportation, shopping areas and education and recreation facilities, and in many residential areas alternate means such as busses, rapid rail or subways are neither close nor convenient. Thus, it is in general consensus that motor vehicles will continue to be considered an all purpose conveyance and the major means of accommodating the transportation needs of an individual or a family as getting to work, shopping, recreation, education or whatever. However, it must be realized that motor vehicles have emission exhaust problems not aligned with propelling the vehicle but in air we breathe. The following are certain measurable results of what automobiles release:

1. Motor vehicles are responsible for up to 50% of volatile organic compounds (VOC's) and nitrogen oxides ($NO_X$). When these gases react with oxygen in the air in the presence of strong sunlight, ozone is formed. Ground-level ozone forms readily in the atmosphere in hot weather. Ozone is a prime ingredient of smog. When inhaled, ozone can damage the lungs.
2. Motor vehicles release more than 50% of the hazardous air pollutants.
3. Motor vehicles release up to 90% of the carbon monoxide found in urban air.

Beginning Jan. 1, 1995 reformulated gasoline was introduced in areas with continuing air pollution problems. Reformulated gasoline produces 15%–17% less pollution than conventional gasoline and further improvements are expected as new formulas are developed.

The following facilities are considered to be available for regular vehicle maintenance service in accord with the manufacturer's recommendations for seasonal, mileage elapsed and type of usage:

1. The conventional drive-in service station located, but not limited to, "Anywhere" U.S.A.
2. The automobile dealer, single or multi brand.
3. An auto mall usually a free standing building with 3 or more separate service sections handling specialty vehicle work.
4. A mall store with a large service area—it might be combined with or in conjunction with tire and battery sales and service.
5. Some independent and chain service units handling vehicle related services such as mufflers, brakes, etc. and auto parts stores may do oil change and other services.
6. Branded or independent outlets whose specialty is in this type of service.
7. An independent garage.
8. There has been some effort at providing on-site servicing of vehicles. The prior art systems have generally required that the vehicle to be serviced be easily accessible so the service person can use jacks or similar equipment to lift portions of the vehicle as needed. Alternatively, the vehicle has been driven onto a service truck or trailer whereon the service person is allowed full access to the various parts of the vehicle.

In order to reduce the health hazards further, the following would be beneficial:

1. Reduce actual emission from gasoline cars now 6 times higher than exhaust emission standards;
2. Reduce growth of pollution from tail pipes, which grows an average of 25% every 10,000 miles.

In reference to what we can do ourselves as driver and owners of motor vehicles to reduce emission pollution, the following should be considered:

1. An integral part of the Clean Air Act encourages transportation planning to limit the growth of vehicle miles driven.
2. Keep the vehicle serviced, well tuned and maintained.
3. Carpooling and reduced driving.

Americans who change their own oil throw away 120 million gallons of recoverable motor oil every year. It often contains such toxicants as lead and benzene in unsafe concentrations. EPA regulations are clear and strict with violators who dispose of oil, used or new, improperly In an Oct. 28, 1989 article in *The New York Times* experts were quoted as saying that the amount of oil dumped by the do-it-yourself auto mechanics" every 2½ weeks is roughly equivalent to the amount spilled by the Exxon Valdez.

Automotive vehicles are commonly left unused in parking lots for extended periods of time; for example, people who drive to work often leave their vehicles unused for eight hours or more. While, from the standpoint of time available, this ought to be an ideal time for servicing the vehicle, from the standpoint of accessibility, this has been a poor time for servicing. Vehicles are usually parked quite close together, and aisles between rows of vehicles are narrow since ingress and egress do not require wide opening of the doors. The result is that one does not have sufficient space at the sides of the vehicles to accommodate the usual jacks and the like.

As can be seen from the foregoing, none of the prior art services reviewed provides an in-place vehicle servicing system.

SUMMARY OF THE INVENTION

The present invention provides an in-place vehicle service system including a vehicle lifting apparatus extendible from beneath the vehicle so that minimum space adjacent to the vehicle is required. In the preferred embodiment of the invention an electronic computer is associated with the lifting apparatus both to control the placement of the lifting devices and to provide servicing information about the particular vehicle being serviced. Alternatively of course, each of the individual lifting devices can be manually directed, and conventional service manuals may be used for vehicle information.

The lifting apparatus of the present invention is arranged to have a low profile to be received beneath substantially any vehicle, and the apparatus includes a plurality of individual lifting devices so the entire vehicle can be lifted simultaneously for servicing of the vehicle.

BRIEF DESCRIPTION OF THE DRAWINGS

These and other features and advantages of the present invention will become apparent from consideration of the following specification when taken in conjunction with the accompanying drawings in which:

FIG. 1 is a schematic, top plan view illustrating a parking lot and showing a servicing system made in accordance with the present invention in place for servicing a vehicle;

FIG. 2 is an enlarged top plan view of the servicing apparatus of FIG. 1, the apparatus being shown in a partially collapsed, or folded position;

FIG. 3 is a cross-sectional view, viewed from the top, of the end of one cross-bar to show the lift device placement means;

FIG. 4 is a cross-sectional view, viewed from the side, of the end of one cross-bar to show the lift device placement means;

DETAILED DESCRIPTION OF THE EMBODIMENT

Figure 5:
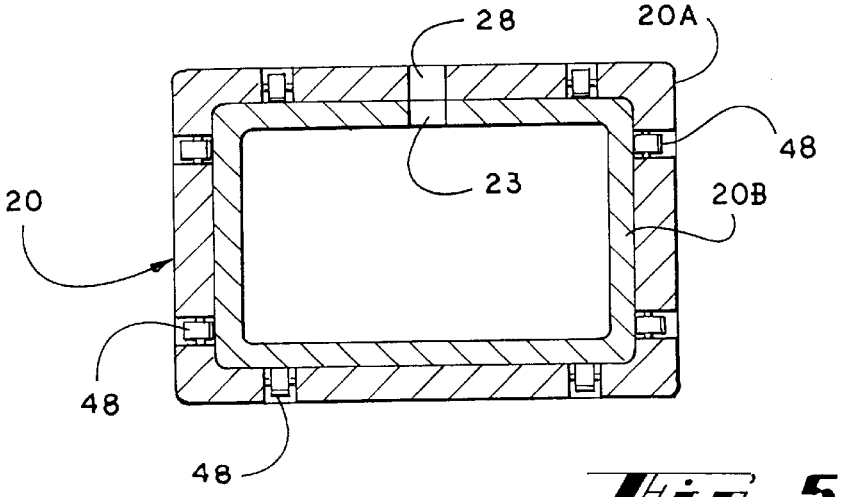
FIG. 5 is an enlarged cross-sectional view taken through the center beam shown in FIG. 2.

Referring now more particularly to the drawings, and to that embodiment of the invention here presented by way of illustration, FIG. 1 shows a lifting apparatus made in accordance with the present invention, in conjunction with a servicing vehicle as contemplated. Specifically, it will be noticed that FIG. 1 shows a portion of a parking lot having a plurality of rows of vehicles. Rows 10 and 11 are shown adjacent to each other; and, it will be understood that there is an aisle 12 between the row 11 and another row (not shown). Similarly, there is an aisle 15 to the right of the row 10. A similar arrangement is used very frequently for parking lots, and there is a large enough portion of a parking lot shown for an understanding of the construction and use of the present invention.

With the above in mind, the concept of the present invention should be understood. The aisles, such as the aisle 12, are generally not wide enough to allow a truck to be aligned with a parked vehicle so the parked vehicle can be entirely moved onto the truck. As is shown in FIG. 1, the servicing truck 16 remains in position extending longitudinally of the aisle 12. In this position, the lifting apparatus generally designated at 18 is removed from the truck 16 and placed under the vehicle to be serviced, the vehicle 19 being shown in phantom to allow illustration of the lifting apparatus 18.

The lifting apparatus 18 comprises a central, longitudinal beam 20 which is placed approximately along the longitudinal centerline of the vehicle 19. Two cross-beams 21 and 22 are pivotally fixed to the central beam 20. As will be discussed more fully hereinafter, each of the cross-beams 21 and 22 has a lifting device at each end thereof. It will therefore be understood by those skilled in the art that, if a lifting device can be placed at each lift point of the vehicle 19, the entire vehicle can be lifted for service.

At one end of the central beam 20, which (for convenience only) shall be designated as the front of the apparatus, there is a console 24. The console 24 will be appropriately connected to the servicing vehicle 16 by hoses, cables and the like. In the preferred embodiment of the invention, the console 24 includes a computer with enough memory that the needed facts about various vehicles can be stored in the computer memory for ready access when a vehicle is to be serviced.

With the above general description in mind, attention is directed to FIG. 2 of the drawings, FIG. 2 showing the lift apparatus 18 in more detail. In FIG. 2 the lift apparatus 18 is shown in a partially folded, or collapsed, position. It will be understood that the device may be fully folded to be stored in the vehicle 16. In this position, each of the cross-beams 21 and 22 is pivoted to approach a position parallel to the central beam 20, and the lift devices are in their most withdrawn positions.

Each of the cross-beams 21 and 22 is pivotal with respect to the central beam 20, and each cross-beam carries lifting devices at its extending ends. The cross-beam 22 is pivoted at its center point to the central beam 20, and is slidable in the longitudinal slot 23. Each end of the cross-beam carries a lifting device here shown as hydraulic jacks 25 and 26. As pictured, the jacks 25 and 26 extend horizontally for the minimum vertical height of the lift apparatus. The cross-beam 21 is pivoted at its center point to the central beam 20; and, the cross-beam 21 is also movable longitudinally along the central beam 20, the pivot sliding within the slot 28. The hydraulic jacks 29 and 30 on the cross-beam 21 also extend horizontally to maintain the minimum vertical height.

The console 24 contains all the control mechanism for the lifting apparatus 18, and the specific apparatus may vary considerably. One might utilize a computer, and arrange the apparatus so the computer controls virtually all functions. Alternatively, one might operate the apparatus almost entirely manually. Numerous stages between these extremes are possible. As shown in FIG. 2, the console 24 includes a display device 31, such as a cathode ray tube, a liquid crystal display, or even a printer that will print the data and diagrams on paper for use by the service technician. Adjacent to the display device 31 is an input device such as a keyboard 32 for data input to the computer. The remainder of the face panel of the console 24 can include switches, indicator lights and the like as needed for the particular configuration chosen.

A control box 34 is provided, here illustrated as connected to the console 24 by a wireless means, which may be radio waves, infra-red or other known technology. The control box 34 allows a service technician to control certain functions at a position remote from the console 24.

FIGS. 3 and 4 of the drawings show some of the details of construction of the cross-beam 21, the projection and retraction means being shown. The lifting device, or jack, 29 is carried on a pivot 39 from a block 40. The block 40 is, in turn, carried on two guide rods 41 and 42, and a threaded rod 44.

The threaded rod 44 has a threaded driving member rotated by the motor 45, so operation of the motor 45 causes either projection or retraction of the threaded rod 44, and consequent motion of the block 40. During this motion, the guide rods 41 and 42 hold the assembly in the rotational position shown.

The pivot 39 is the shaft of a motor 46, so when the motor 46 is energized, the shaft 39 will rotate, thereby rotating the jack 29. A servo motor or the like can be used to obtain the proper amount of rotation; or, limit switches or other known means can be used to limit the rotation.

With the foregoing description of the apparatus in mind, the operation should be understandable. One will select the vehicle to be serviced and, with the lifting apparatus in its collapsed condition, the lifting apparatus will be slid under the vehicle with the central beam 20 extending approximately along the longitudinal centerline of the vehicle. The central beam 20 telescopes, and the cross beams 21 and 22 rotate, so the lifting apparatus can be made small enough to be placed under the vehicle from either side of the vehicle, or from either the front or the back of the vehicle. One would generally select the most convenient location from which to insert the lifting apparatus 18. Then, the cross-beam 22 will be rotated to be generally perpendicular to the central beam 20, and the apparatus will be moved if necessary to align the lifting devices with the lifting points of the vehicle. Next, the lifting devices will be moved in or out for complete alignment with the lifting points.

After the first lifting devices are placed, the cross-beam 21 will be rotated to be perpendicular to the central beam, and the cross-beam 21 will be moved along the slot 28 to align the beam with the lift points. The lifting devices will then be moved in or out as required for complete alignment with the lift points. The lifting devices can now be operated to lift the vehicle for servicing. In accordance with usual practice, jack stands may be placed for safety, or acceptable safety arrangements may be included in the lifting devices.

It will be noticed in FIG. 2 that the central beam 20 is designed to telescope, and the mechanical arrangement is better shown in FIG. 5. There is an outer member 20A and an inner member 20B. These two members are sized for easy sliding movement of one within the other; and, to reduce frictional drag, rollers are provided. As here shown, there are two rollers on each of the four sides of the members, the rollers being designated at 48. The rollers 48 are received within appropriate slots in the outer member 20A, and are on fixed axles. All the rollers are alike, so all carry the same reference numeral.

Figure 6:
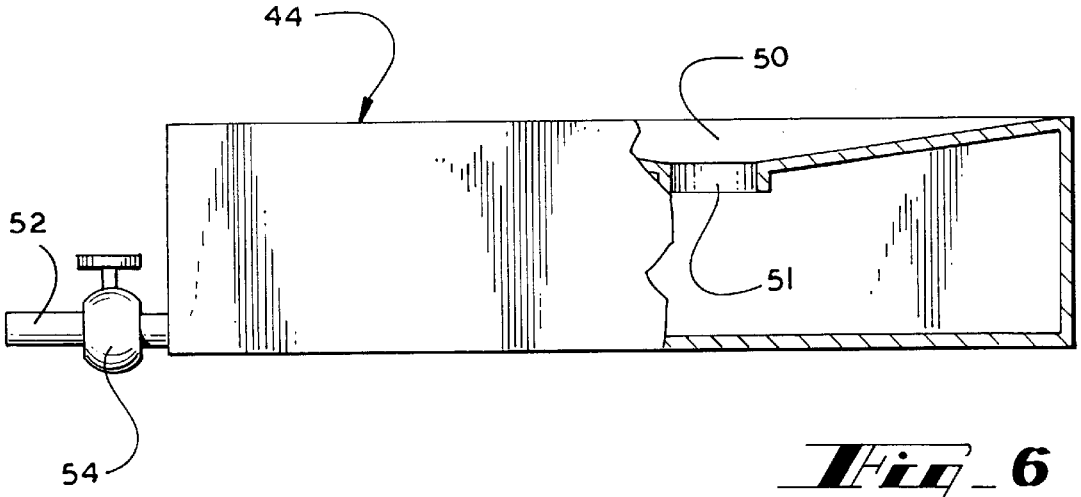
FIG. 6 is a side elevational view, partially in cross-section, showing a fluid collection pan for use with the present invention.

Those skilled in the art will understand that the vehicle is raised as little as possible to allow the service. As a result, one requires a low profile pan into which to drain oil or other fluids. Such a pan is shown in FIG. 6 of the drawings. The drain pan 49 is a low profile container having a funnel top 50 with a central opening 51. If desired, a screen or the like can be placed over the opening 51 so the oil pan plug can be dropped onto the top 50 without losing the plug.

For draining the pan 49, there is a pipe 52 having a valve 54 for selectively allowing retention or draining of the pan. The pipe 52 is long enough that a tube can be placed thereon to direct the fluid as required.

Figure 7:
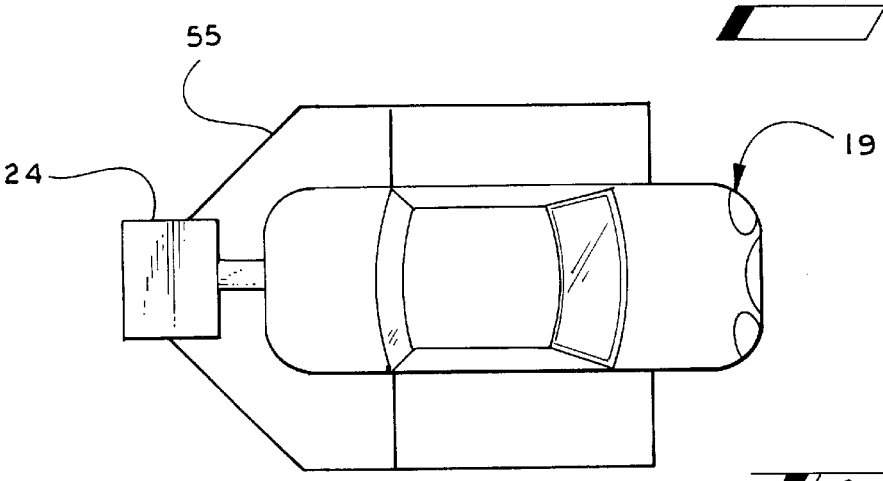
FIG. 7 is a top plan view of a vehicle schematically showing hydraulic lines for operation of the lifting devices of the present invention; and, FIG. 8 is a flow diagram showing the computer operation for use of the apparatus of the present invention.

The above discussion mentions actuation of the jacks 25 et seq., but does not discuss the exact means for such actuation. In FIG. 7 of the drawings the hydraulic lines are shown schematically. It will be understood that the control unit 24 may have the necessary apparatus, or the service truck 16 may have the apparatus. Nevertheless, fluid under pressure will be supplied through the lines 55 to each of the jacks 25 et seq. to cause the jacks to lift the vehicle.

Figure 8:
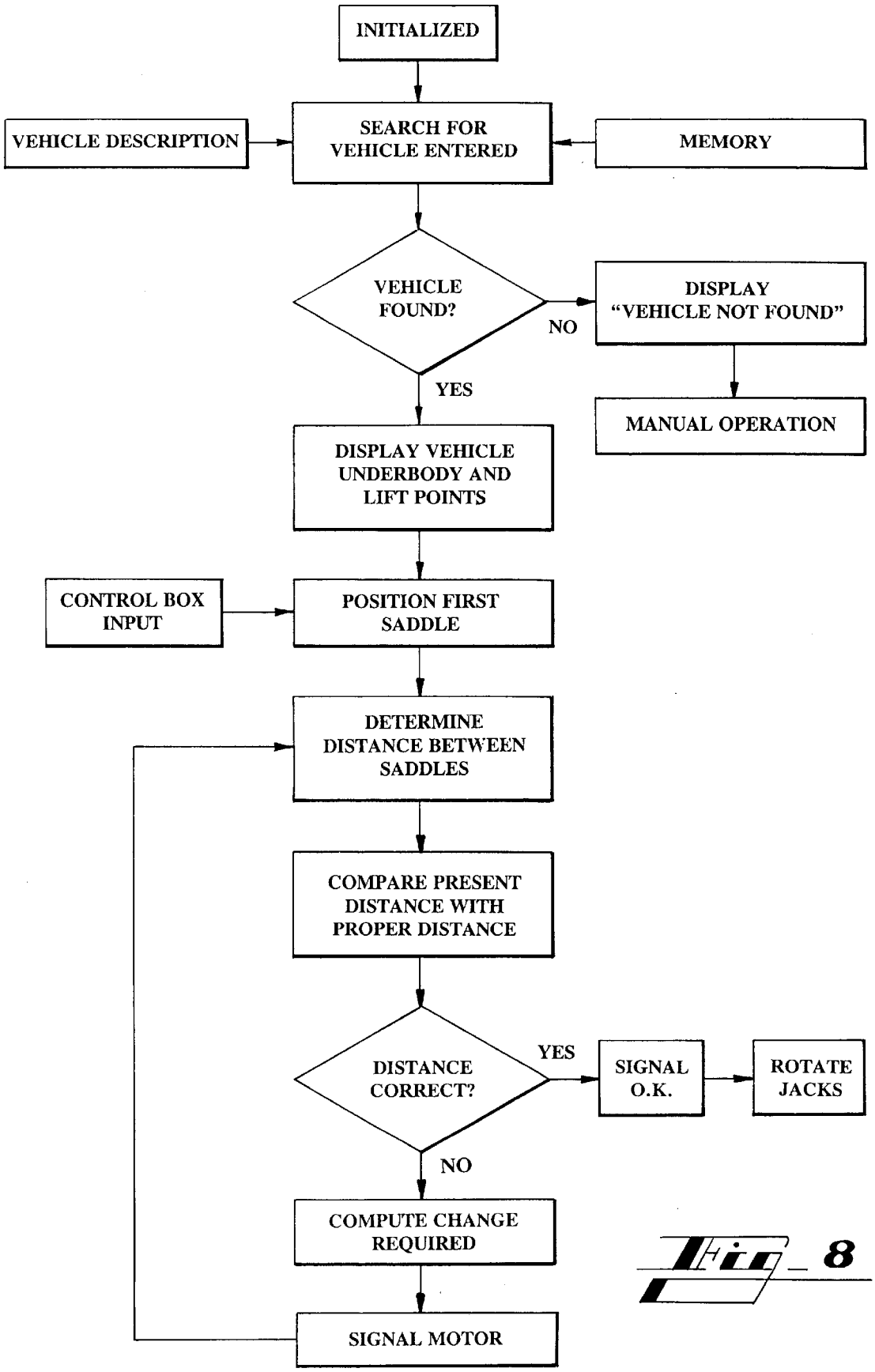

Looking now at FIG. 8 of the drawings, the logic of the computer programming is shown for the arrangement contemplated by the present invention.

First, the program will be initialized, then the identification of the vehicle to be serviced will be entered via the input device 32. The memory will be searched for a match; and, if a match is found, the vehicle underbody will be displayed on the display device 31. If the vehicle is not found, an appropriate message will be displayed, and the operation must go to manual. It should be understood that, for manual operation, the control may be entirely from the control box 34 controlled by the service technician.

Returning to the automatic operation, the first lifting device is positioned manually, the service technician will rotate the cross beam 22, move the central beam 20 as needed, then use the control box 34 to project or retract the lifting device for placement under the lift point of the vehicle. In placing the lifting device, the motors 45 will be operated. The computer will remember this operation so the next steps will have the benefit of the current facts. Knowing the initial distance, and the added distance, the computer can determine the distance between lifting devices 25 and 26. This distance is therefore computed with the proper distance taken from memory, and a comparison is made. If the distance is correct, an OK signal is generated, and the motor 46 is operated to rotate the jacks 25 and 26. There is a query as to whether the distance is correct. If NO, the required change is computed, and the motors 45 are operated to make the correction. If YES, an "OK" signal is given and the jacks are rotated. The comparing and correcting steps are in a loop so the process can continue until the distance is correct, and the jacks are rotated to lifting position.

It will be understood that the same process will be utilized for the cross-beam 21, so the description of the process will not be repeated here. The one difference for the cross-beam 21 is the movement of the beam 21 along the central beam 20. If the computer is to determine the position, there will have to be an appropriate input means, which may be a stepper motor, a series of limit switches, or an electronic positioning means such as a Wheatstone bridge. Those skilled in the art will be able to select the apparatus preferred for the particular design. Otherwise, of course, the service technician may simply control placement of the cross-beam 21 by means of the control box 34.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. An automotive vehicle servicing system comprising a servicing vehicle, a vehicle lift apparatus selectively receivable in said servicing vehicle and removable therefrom for lifting a vehicle to be serviced, said vehicle to be serviced being on a supporting surface and having a plurality of lift points, said vehicle lift apparatus comprising a central beam extendible beneath said vehicle to be serviced, a first cross-beam and a second cross-beam pivotally carried by said central beam, and a plurality of lift devices carried by said cross-beams, said first and second cross-beams being selectively pivotal to a collapsed position approaching parallel to said central beam and an extended position substantially perpendicular to said central beam, one lift device of said plurality of lift devices being carried at each end of said first and said second cross-beams for lifting said vehicle to be serviced from said supporting surface.

2. An automotive vehicle servicing system as claimed in claim 1, said first cross-beam being pivotal with respect to said central beam for aligning said lift devices carried by said first cross-beam with two lift points of said plurality of lift points.

3. An automotive vehicle servicing system as claimed in claim 2, wherein said second cross-beam is movable along said central beam and pivotal with respect to said central beam for aligning said lift devices carried by said second cross-beam with two lift points of said plurality of lift points.

4. An automotive vehicle servicing system as claimed in claim 3, and further including control means fixed to said central beam, said control means including storage means for storing information about said vehicle to be serviced.

5. An automotive vehicle servicing system as claimed in claim 4, and further including means for pivotally mounting said lift devices to said cross-beams so that said lift devices can extend horizontally during placement of said lifting device and can be rotated to extend vertically for lifting said vehicle to be serviced.

6. An automotive vehicle servicing system as claimed in claim 5, said means for pivotally mounting said lift devices comprising a pivot rod extending from said cross-beam, said lift device being mounted on said pivot rod for rotation therewith.

* * * * *